US008477567B2

(12) United States Patent
Greubel et al.

(10) Patent No.: US 8,477,567 B2
(45) Date of Patent: Jul. 2, 2013

(54) TIMEPIECE

(75) Inventors: Robert Greubel, Lignieres (CH); Stephen Forsey, Les Brenets (CH)

(73) Assignee: CompliTime SA, La Chaux-de-Fonds (CH)

( * ) Notice: Subject to any disclaimer, the term of this patent is extended or adjusted under 35 U.S.C. 154(b) by 72 days.

(21) Appl. No.: 13/147,717

(22) PCT Filed: Feb. 4, 2010

(86) PCT No.: PCT/EP2010/051389

§ 371 (c)(1), (2), (4) Date: Aug. 3, 2011

(87) PCT Pub. No.: WO2010/092002

PCT Pub. Date: Aug. 19, 2010

(65) Prior Publication Data

US 2011/0292771 A1 Dec. 1, 2011

(30) Foreign Application Priority Data

Feb. 10, 2009 (EP) ..... 09152482

(51) Int. Cl.
*G04B 19/02* (2006.01)

(52) U.S. Cl.
USPC ..... 368/220; 368/313

(58) Field of Classification Search
USPC ..... 368/313, 281, 220–222
See application file for complete search history.

(56) References Cited

U.S. PATENT DOCUMENTS

| | | | | |
|---|---|---|---|---|
| 4,444,513 | A | 4/1984 | Proellochs et al. | |
| 5,050,138 | A * | 9/1991 | Yamada et al. | 368/10 |
| 5,138,590 | A * | 8/1992 | Masuda et al. | 368/10 |
| 5,262,763 | A * | 11/1993 | Okuyama et al. | 345/87 |
| 6,618,328 | B1 * | 9/2003 | Ellner et al. | 368/88 |
| 6,940,785 | B2 * | 9/2005 | Ellner et al. | 368/88 |
| 6,944,098 | B2 * | 9/2005 | Rochat et al. | 368/88 |

FOREIGN PATENT DOCUMENTS

| | | | |
|---|---|---|---|
| CH | 640 688 | A3 | 1/1984 |
| CH | 680 329 | A3 | 8/1992 |
| EP | 1 513 031 | A1 | 3/2005 |
| EP | 1 840 678 | A1 | 10/2007 |

OTHER PUBLICATIONS

International Search Report, dated May 6, 2010, from corresponding PCT application.

* cited by examiner

*Primary Examiner* — Sean Kayes
(74) *Attorney, Agent, or Firm* — Young & Thompson

(57) ABSTRACT

A timepiece having a mechanical clock movement and separate first and second cases (2, 3), the movement including first and second portions housed in the first and second cases (2, 3), respectively, the cases (2, 3) being mutually connected in a rotatably hinged manner via a hinge (4) defining a pivot axis so as to be capable of forming a variable angle between the cases, the part further including a controller arranged to transmit information from one portion of the movement to the other. The controller includes at least one rod (15) slidably mounted in the hinge along an axis substantially parallel to the pivot axis and engaging with the first and second portions of the clock movement for transmitting information from one portion of the movement to the other, by a linear, alternating movement, regardless of the relative position of the two cases (2, 3).

11 Claims, 6 Drawing Sheets

TIMEPIECE

TECHNICAL FIELD

The present invention relates to a timepiece comprising a mechanical clockwork movement, first and second distinct cases, said movement including first and second parts respectively housed in first and second cases, said cases being connected to each other hinged in rotation via a hinge defining a pivot axis so as to be able to form a variable angle between them, said piece also including a control device arranged to transmit information from one to the other of the parts of the movement. Mechanics here refers to a movement including mobile parts, animated by a spring or an electric motor.

BACKGROUND OF THE INVENTION

A timepiece of this type is for example described in patent application EP 1 513 031. In this example, the two cases pivot relative to each other around a pivot axis substantially perpendicular to the plane of the cases, so that the two cases slide one on the other when they are moved. In this way, the upper case is pivoted relative to the lower case to reveal at least part of the front face thereof. The drawback of such a construction is that the lower case still remains at least partially hidden by the upper case. This requires that the display means be positioned on the lower case eccentrically so that they are still visible, and therefore that specific pieces be provided. The information is sent from one case to the other via an arbor rotating around an axis combined with that of the hinge. With such a configuration, the rotational movement of one of the cases relative to the other is of the same type as the control movement. This involves a complex mechanism to guarantee the transmission of information despite this relative movement, or an interruption of the kinematic connection, as proposed by the mechanism mentioned above.

Also known is a timepiece as described in patent application EP 1 840 678, comprising a first watch case reversible according to two service positions, containing a clockwork movement, a second watch case comprising an additional mechanism, and a control device by mechanical impulses contained in the first watch case. More particularly, the elements of this control device are arranged in the space between the two cases, in which space dust can become lodged, which can harm the operation of the piece. Moreover, the device comprises a lever ensuring the transmission between the two cases, the lever being positioned in a groove of the cradle in which the additional mechanism is mounted. This means that outside the two service positions, i.e. when the case is open and is not superimposed on the second case, the lever no longer cooperates with the movement and the transmission of the information from the movement to the additional module is no longer ensured. It is therefore required for the first case to be in one of its service positions at midnight, when the movement provides an impulse to the date module. If the first case is in an open position relative to the second case, the update does not occur. Moreover, the transmission of information at a frequency greater than once a day could lead to serious lags, detrimental to the precision of the additional mechanism.

One aim of the present invention is therefore to offset these drawbacks, by proposing a timepiece in which the information is always transmitted from one part of the movement to the other, regardless of the position of the cases relative to each other.

BRIEF DESCRIPTION OF THE INVENTION

To that end, and according to the present invention, proposed is a timepiece comprising a mechanical clockwork movement, first and second distinct cases, said movement having first and second parts respectively housed in the first and second cases, said cases being connected to each other so as to be rotatably hinged via a hinge defining a pivot axis so as to be able to form a variable angle between them, said timepiece also including a control device arranged to transmit information from one part of the movement to the other. According to the invention, the control device comprises at least one arbor slidingly mounted in said hinge along an axis substantially parallel to said pivot axis and cooperating with the first and second parts of the clockwork movement to thereby ensure the transmission of information from one part of the movement to the other, through a linear and alternating movement, regardless of the relative position of the two cases.

According to one alternative embodiment, the cases can define reference planes, the hinge being arranged so as to be able to pivot around an axis substantially parallel to said planes.

Preferably, the hinge is provided with a housing extending parallel to the axis of the hinge.

Advantageously, the control device can also comprise first actuating means cooperating on the one hand with components of one of the first and second parts, and on the other hand with the arbor, and second actuating means cooperating on the one hand with the arbor and on the other hand with components of the other part of the movement, said first and second actuating means respectively being arranged to move said arbor regardless of the relative position of the two cases.

According to one alternative of the invention, the first actuating means can comprise a cam cooperating on the one hand with a wheel of one of the first and second parts of the movement and on the other hand with a first lever arranged to cooperate with the arbor irrespective of the relative position of the two cases.

Preferably, the arbor can comprise, at one of its ends, a first circular groove and said first lever can comprise, at its end opposite the arbor, a finger engaged in said first circular groove and able to circulate around said first circular groove.

Advantageously, the second actuating means can comprise a second lever arranged to cooperate on the one hand with components of the other part of the movement, and on the other hand with the rod irrespective of the relative position of the two cases.

Preferably, the arbor can comprise, at its other end, a second circular groove and said second lever can comprise, at its end opposite the arbor, a finger engaged in said second circular groove and able to circulate around said second circular groove.

Advantageously, the control device can comprise a return member arranged to return the arbor to its initial position when the information has been transmitted from one part of the movement to the other.

Preferably, the hinge comprises, in its housing, a sheath in which the arbor can move axially.

BRIEF DESCRIPTION OF THE DRAWINGS

Other features of the present invention will appear more clearly upon reading the following description, done in reference to the appended drawings, in which.

DETAILED DESCRIPTION OF THE INVENTION

Figure 1:
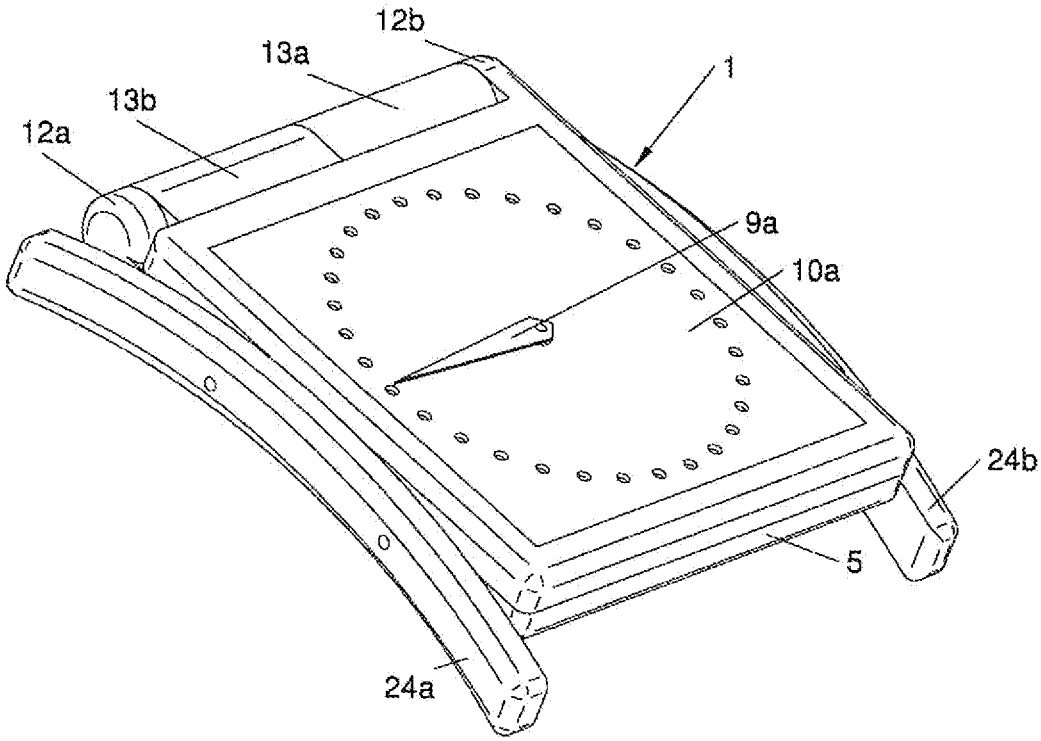
FIG. 1 is a perspective view of a timepiece according to the invention, the cases being in the closed position.
Figure 2:
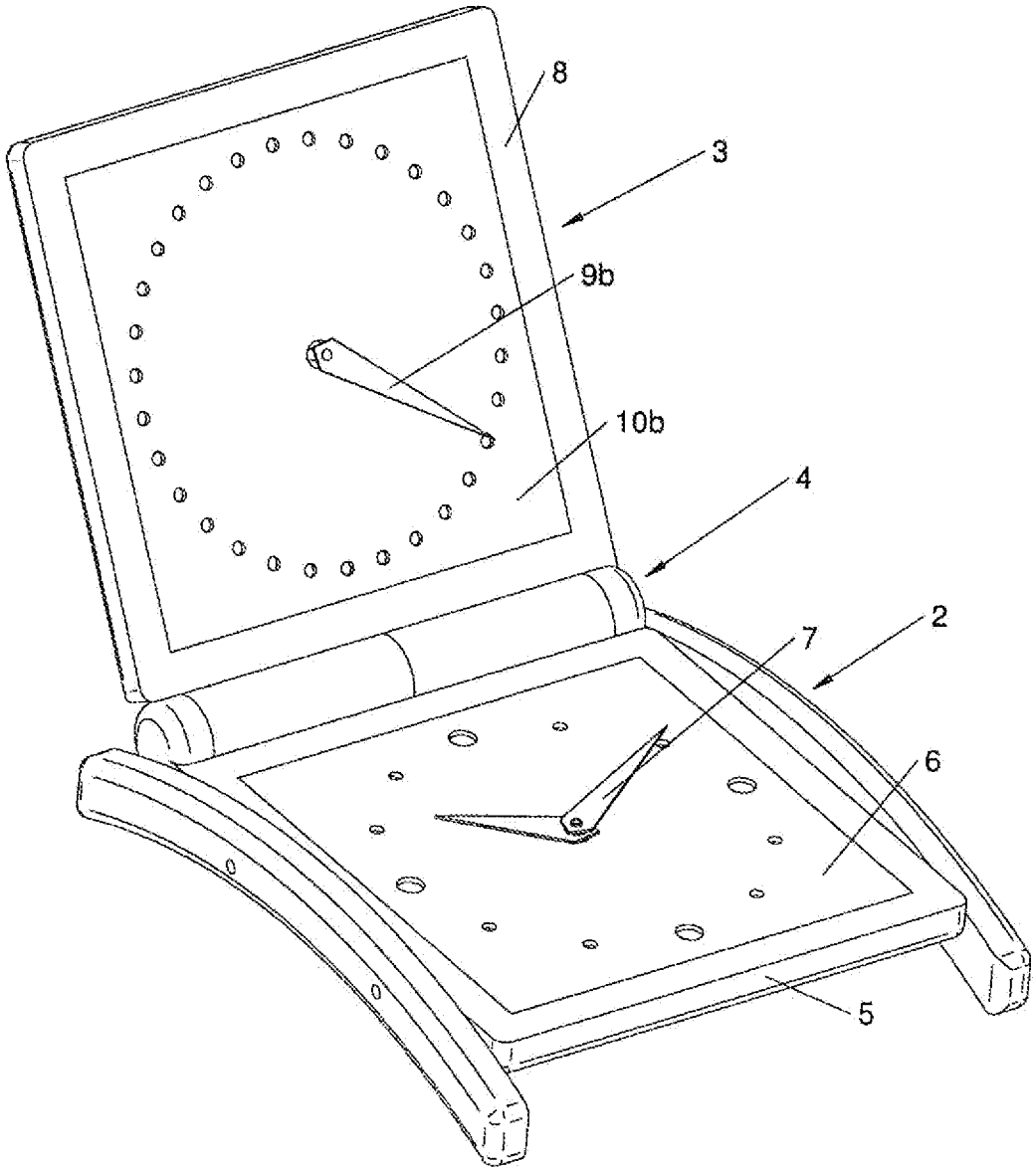
FIG. 2 is a perspective view of the timepiece of FIG. 1, the cases being in an open position.
Figure 3:
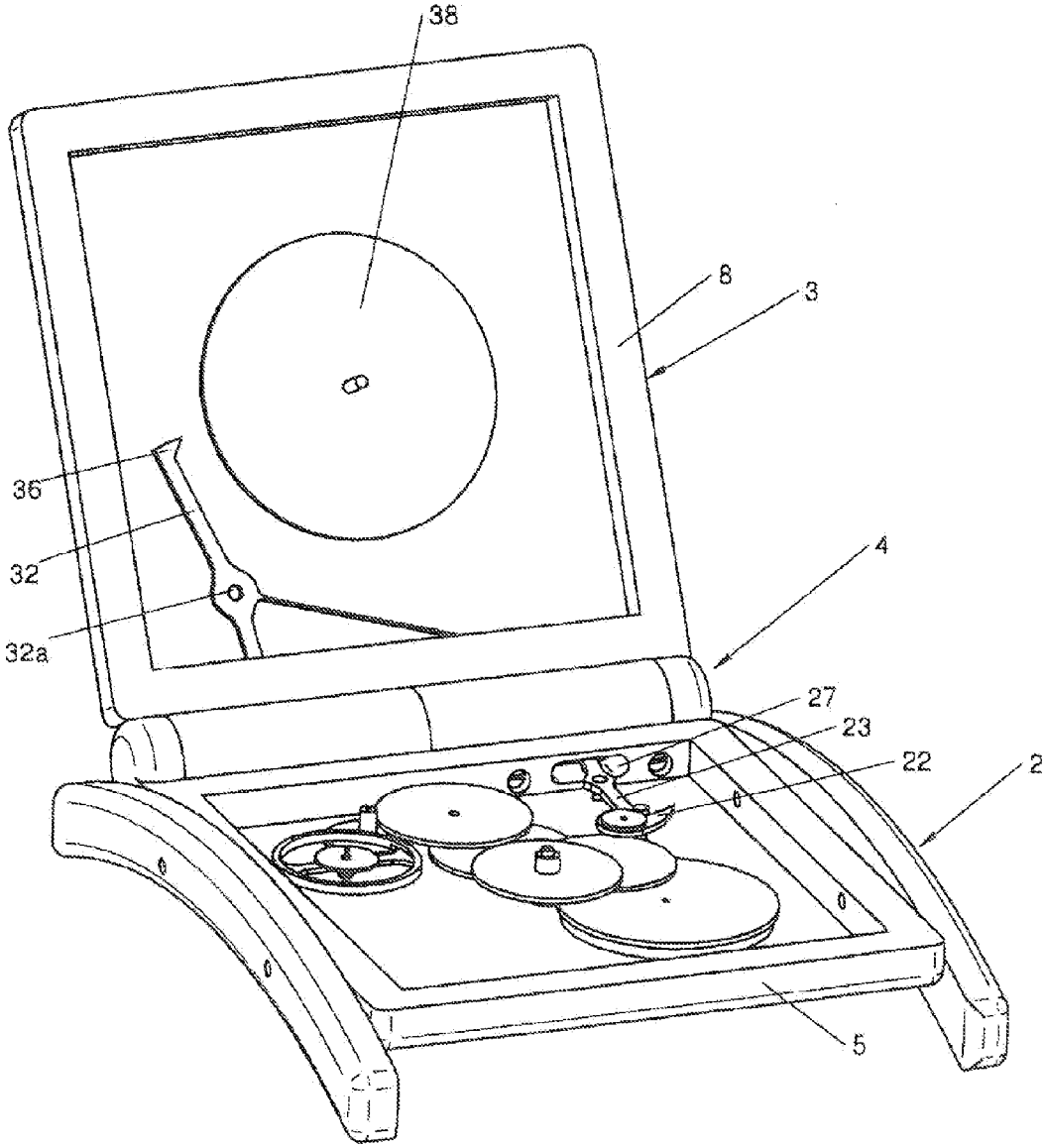
FIG. 3 is a perspective view of the timepiece of FIG. 2, the dials and display means having been removed.
Figure 4:
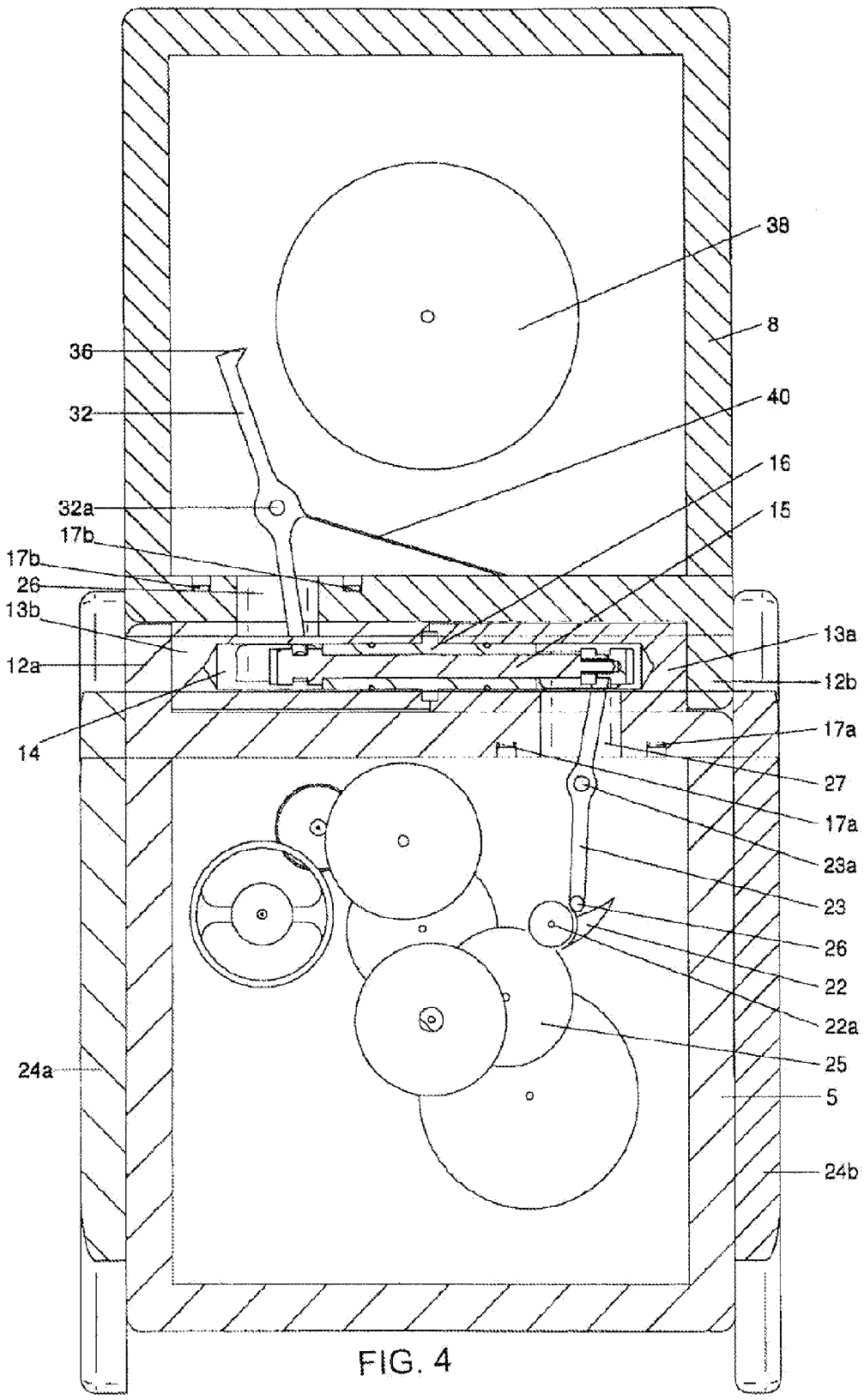
FIG. 4 is a cross-sectional view of the timepiece of FIG. 3, the arbor being in its initial position.
Figure 5:
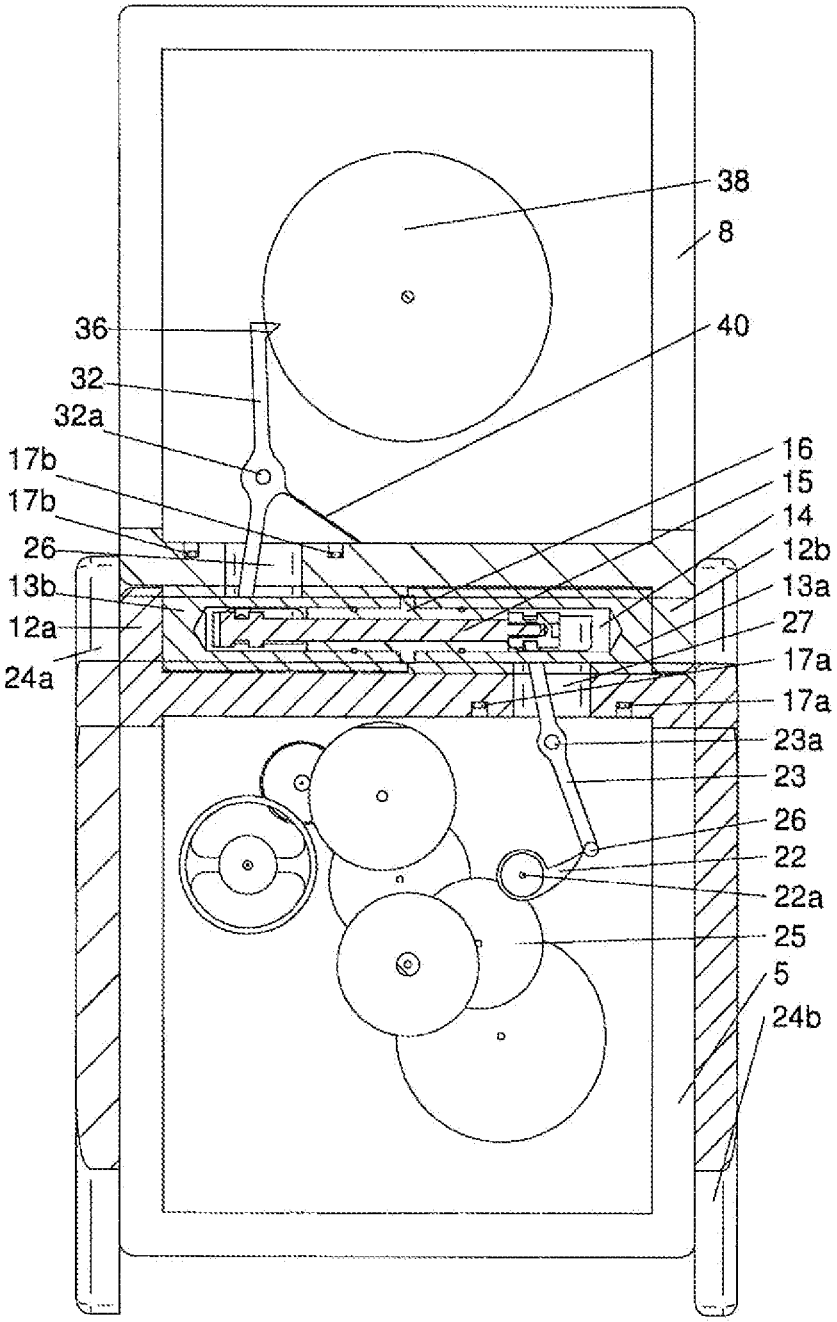
FIG. 5 is a cross-sectional view of the timepiece of FIG. 3, the arbor being in its final position.

FIGS. 1 and 2 show a timepiece 1 comprising two cases 2 and 3 hinged relative to each other using a hinge 4. The first case 2 has, traditionally, a middle 5 closed by a glass, and contains a first part of a traditional mechanical clockwork movement, having a dial 6 and a hand 7 making it possible to display the hour and the minute. The first case 2 defines a first reference plane.

The second case 3 comprises a middle 8 closed on each side by a glass, and contains a second part of the movement, i.e. a mechanical date module, with two faces, comprising, on either side of the second case 3, an upper hand 9*a* and dial 10*a* and a lower hand 9*b* and dial 10*b* for displaying the date. Obviously the first and second parts can contain components having other functions. The second case 3 defines a second reference plane.

Each case 2, 3 respectively has a tab 12*a*, 12*b*, protruding on the edge corresponding to its back end, the two tabs 12*a*, 12*b* being arranged at the opposite ends of the cases 2 and 3. Between the pads 12*a*, 12*b*, two hinge elements 13*a*, 13*b* are introduced so as to cooperate with each other to form the hinge 4. The hinge element 13*a* is screwed to the middle 5 of the case 2 using screws 17*a*, while the hinge element 13*b* is screwed to the middle 8 of the case 3 using screws 17*b*. The case 5 blocks the element 13*b* via its tab 12*a* while the case 8 blocks the element 13*a* by its tab 12*b*. Flanges 24*a*, 24*b* are provided on the lateral edges of the cases 2 and 3 and have ends that constitute horns for fastening a bracelet.

Thus, the cases 2, 3 are hinged in rotation using the hinge 4 and can occupy the closed position in which the two cases 2, 3 are superimposed, as shown in FIG. 1, or an open position, in which the cases 2, 3 form a non-zero angle between them, as shown in FIG. 2.

According to the invention, the hinge 4 is arranged so as to be able to pivot around an axis substantially parallel to said reference planes.

In reference to FIGS. 3 to 6, the hinge 4 comprises a housing extending parallel to the axis of said hinge 4. Said housing 14 contains a control device arranged to transmit, to the date module housed in the second case 3, a piece of information, i.e. in this example, an impulse commanding a date change, delivered by components of the first part of the clockwork movement housed in the first case 2.

According to the invention, the control device comprises an arbor 15 slidingly mounted in a sheath 16 engaged in the hinge elements 13*a*, 13*b*. The arbor 15 is arranged to move in the axial direction between an initial position and a final position in the housing 14 of the hinge 4, as a function of the advancement of the day.

Figure 6:
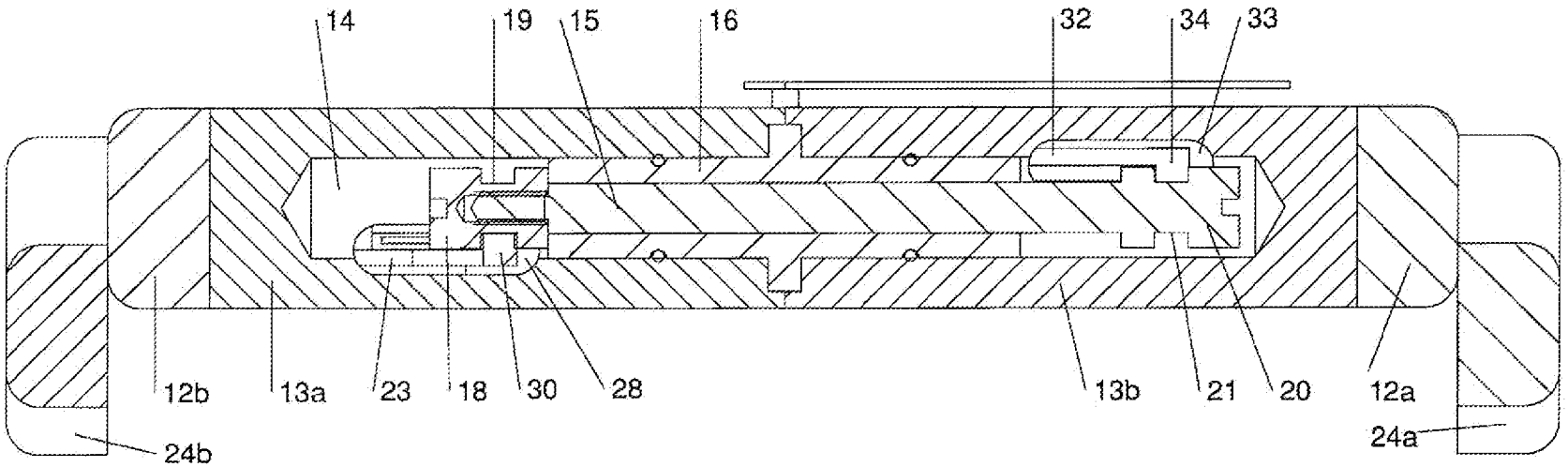
FIG. 6 is a rear cross-sectional view of FIG. 5.

In reference more precisely to FIG. 6, the arbor 15 comprises, at its first end, a tip 18 that can be disassembled, for example by screwing, allowing the arbor 15 to be inserted into the sheath 16 so as to be able to place it. The tip 18 has a diameter larger than that of the arbor 15, and also makes it possible to abut against the sheath 16.

Once the arbor 15 is introduced into the sheath 16, the hinge elements 13*a*, 13*b* are mounted on each side of the assembly. The hinge elements 13*a*, 13*b* containing the sheath 16 and the arbor 15 are then inserted between the tabs 12*a*, 12*b* of the cases 2 and 3 and screwed, as described above.

The tip 18 comprises, on its outer perimeter, a circular groove 19, the function of which will be described later.

The second end 20 of the arbor 15 also has a diameter larger than that of the arbor 15 so as to abut against the sheath 16. The second end 20 comprises, on its outer perimeter, a circular groove 21 whereof the function will be described later.

Provided between the arbor 15 and the components of the first part of the movement housed in the first case 2 are a cam 22 and a first lever 23, pivotably mounted around an axis 22*a*, 23*a* respectively, secured to the frame of the first part of the movement, constituting the first actuating means.

The cam 22 cooperates with the components of the first part of the movement, for example a date wheel 25, so that the cam 22 is arranged to perform one revolution in 24 hours.

Furthermore, the cam 22 cooperates with a stud 26 provided at one end of the first lever 23 so as to pivot the first lever 23 around its axis 23*a* until the cam 22 reaches its upper position.

Oblong holes 27, 28 are provided in the middle 5 of the first case 2, then in the hinge element 13*a*, respectively, allowing the passage of the first lever 23. The other end of the first lever 23 includes a finger 30 capable of circulating around the groove 19 provided in the tip 18 of the arbor 15, irrespective of the position of the first case 2.

Provided in the second case 3 is a second lever 32 pivotably mounted around an axis 32*a* secured to the frame of the second part of the movement, and constituting the second actuating means. An oblong hole is provided in the middle 8 of the second case 3, another oblong hole 33 is provided opposite the hinge element 13*b*, allowing the passage of the second lever 32. At its end on the arbor 15 side, the second lever 32 has a finger 34 capable of circulating around the groove 21 of the end 20 of the arbor 15 irrespective of the position of the second case 3.

At its other end, the second lever 32 has a beak 36 arranged to cooperate with a toothed date wheel 38 of the date module.

A return spring 40 is provided connecting the second lever 32 to the arbor 15, allowing the second lever 32 and the arbor 15 to return to their initial position when the cam 22 has exceeded its maximum position and the first lever 23 has returned to its initial position.

It will be noted that the lever 32, once it is provided with a spring 40, could simply be bearing against the end of the arbor 15 rather than having to be engaged in the groove 21.

At the beginning of the day, the arbor 15 occupies its initial position. When the day progresses, the cam 22 pivots around its axis 22*a* and drives the stud 26 of the first lever 23 so as to make the first lever 23 pivot counterclockwise. The pivoting of the first lever 23 drives an axial movement of the arbor 15 towards the left in FIG. 4, and an axial movement of the finger 34 of the second lever 32 so that the second lever 32 pivots in turn, clockwise, coming closer to the date wheel 38 of the date module.

When the cam 22 reaches its upper position, the first lever 23 is in its maximum pivot position, and the arbor 15 reaches its final position. The second lever 32 also reaches its maximum pivot position such that its beak 36 terminates an impulse that advances the date wheel 38 of the date module by one pitch.

Once the impulse is given, the cam 22 exceeds its upper position, and the arbor 15 returns to its initial position under the action of its return spring 40, the first 23 and second 32 levers also returning to their initial position.

The control device makes it possible to give an impulse to the date wheel of the date module, this impulse making said date wheel advance by one pitch per day, the information on the date change coming from the first part of the movement, irrespective of the position of the cases.

Of course, numerous alternatives can be considered without going beyond the scope of the invention.

Thus, the two cases can be superimposed, as illustrated in the drawings, but they could also be juxtaposed, similarly to two or more bracelet links.

The transmission of information not depending on the relative position of the two cases, the transmission frequency of information between them can be much higher, or every hour for example, or even every minute. In this way, the first and second parts of the movement can have many different functions. It is in particular possible to provide a second part displaying another time zone, or performing a waking function, for example, the first part corresponding to a base movement. It would also be possible only to display the time using the second part of the movement, then the information relative to the second and minute would appear on the base movement corresponding to the first part.

Rather than putting a base movement in one of its cases, and a complementary module in the other, it is also possible to distribute the base movement in both cases, with, for example, the energy source in one, the time base in the other.

It will also be noted that the hinge can advantageously be provided with sealing joints, which makes it possible to avoid deterioration of the component parts of the watch housed inside the cases.

In the alternative described above, the arbor 15 is commanded using a lever 23, which itself is driven by a cam. Obviously other actuating means can be contemplated to obtain an alternative movement, for example a connecting rod or an escapement system. This last solution is particularly well suited to the case where the energy source and the time base are not located in the same case. It is also possible to provide a toothed sector animated by an alternative linear movement cooperating with different grooves made on the arbor.

Bearings made from a material with a low coefficient of friction, for example ruby, could be driven into the sheath 16, to reduce the friction of the arbor 15 in its movements.

The operation of the lever 32 could also be modified and reversed relative to the described alternative, by gradually moving the wheel 38 away through the action of the cam 22 on the lever 23, the spring 40 returning the beak 36 against the wheel 38 to make it advance by one pitch when the cam 22 exceeds its upper position.

In the described embodiment, the information is transmitted from one case to the other by a single arbor. It is also possible to contemplate a dual transmission, for example using a coaxial sheath and arbor, and arranged in the housing included in the hinge. In the case where the relative amplitude of the cases on the hinge is low, it would also be possible to transmit the information using several arbors arranged in contiguous and parallel housings, typically two, three, or even four arbors.

Thus, owing to the fact that the information is transmitted by an axial movement and not a rotational one, which is usually much more favorable, it is possible to connect two parts of a timepiece movement, each housed in a case, while also offering great diversity in the functions displayed by the first or second parts.

The invention claimed is:

1. A timepiece, comprising:

a mechanical clockwork movement; and first and second distinct cases, said movement having first and second parts respectively housed in the first and second cases, said cases being connected to each other so as to be rotatably hinged via a hinge defining a pivot axis so as to be able to form a variable angle between them, said timepiece also including a control device arranged to transmit information from one part of the movement to an other part of the movement, wherein the control device comprises at least one arbor slidingly mounted in said hinge along an axis substantially parallel to said pivot axis and cooperating with the first and second parts of the clockwork movement to thereby ensure the transmission of information from one part of the movement to the other part of the movement, through a linear and alternating movement, regardless of the relative position of the two cases.

2. The timepiece according to claim 1, wherein the cases define reference planes, and wherein the hinge is arranged so as to be able to pivot around an axis substantially parallel to said planes.

3. The timepiece according to claim 2, wherein said hinge is provided with a housing extending parallel to the axis of the hinge.

4. The timepiece according to claim 1, wherein said hinge is provided with a housing extending parallel to the axis of the hinge.

5. The timepiece according to claim 4, wherein the hinge comprises, in said housing, a sheath in which the arbor can move axially.

6. The timepiece according to claim 1, wherein the control device also comprises i) first actuating means cooperating with components of one of the first and second parts, and also cooperating with the arbor, and ii) second actuating means cooperating with the arbor and also cooperating with components of the other part of the movement, said first and second actuating means respectively being arranged to move said arbor regardless of the relative position of the two cases.

7. The timepiece according to claim 6, wherein the first actuating means comprises a cam cooperating with a wheel of one of the first and second parts of the movement and also cooperating with a first lever arranged to cooperate with the arbor irrespective of the relative position of the two cases.

8. The timepiece according to claim 7, wherein a first end of the arbor comprises a first circular groove, and wherein an end of said first lever opposite the arbor comprises a finger engaged in said first circular groove and able to circulate around said first circular groove.

9. The timepiece according to claim 6, wherein the second actuating means comprises a second lever arranged to cooperate with components of the other part of the movement, and also with the rod irrespective of the relative position of the two cases.

10. The timepiece according to claim 9, wherein a second end of the arbor comprises a second circular groove and wherein an end of said second lever opposite the arbor comprises a finger engaged in said second circular groove and able to circulate around said second circular groove.

11. The timepiece according to claim 1, wherein the control device comprises a return member arranged to return the arbor to an initial position when the information has been transmitted from one part of the movement to the other.

* * * * *